United States Patent [19]

Baggio et al.

[11] Patent Number: 4,841,420

[45] Date of Patent: Jun. 20, 1989

[54] STRING LIGHTS FOR CONSTRUCTION SITES

[75] Inventors: Horacio A. Baggio, Niles; George R. Eckart, Evanston, both of Ill.

[73] Assignee: Woodhead Industries, Inc., Northbrook, Ill.

[21] Appl. No.: 209,322

[22] Filed: Jun. 20, 1988

[51] Int. Cl.[4] ..... F21V 15/02

[52] U.S. Cl. ..... 362/249; 362/378; 362/391

[58] Field of Search ..... 362/249, 376, 378, 391; 439/395, 396, 409, 410

[56] References Cited

U.S. PATENT DOCUMENTS

| | | | |
|---|---|---|---|
| 445,259 | 1/1891 | Curtis et al. | 362/377 |
| 1,414,906 | 5/1922 | Trulock | 362/378 |
| 2,142,362 | 1/1939 | Ludwig | 362/378 |
| 2,259,237 | 10/1941 | Baker et al. | 240/102 |
| 2,291,906 | 8/1942 | Kollath | 240/102 |
| 2,975,392 | 3/1961 | Ludwig | 339/99 |
| 3,397,379 | 8/1968 | Puig | 339/99 |
| 3,826,912 | 7/1974 | Pomroy | 362/378 |
| 4,141,062 | 2/1979 | Trueblood | 362/378 |
| 4,283,107 | 8/1981 | Anthony | 339/147 R |
| 4,529,258 | 7/1985 | Anthony | 339/99 |

OTHER PUBLICATIONS

McGill "String-O-Light" Temporary Lighting literature, no date.
State Wire & Cable Corp. brochure, 1981.
M & M Plastics Corp. brochure, no date.
Ericson Electrical Specialties brochure, no date.
Electrical Conductors, Inc.—"Span-O-Lite" brochure, 1981.
Illinois Tool Works, Fastex Division, Socket with Insulation-Displacement Connectors, 1983.
AMP Electro-Tap Connector brochure, no date.
"Scotchlok" Self-Stripping Electrical Pigtail and Tap Connectors brochure, no date.

*Primary Examiner*—Ira S. Lazarus
*Assistant Examiner*—Richard R. Cole
*Attorney, Agent, or Firm*—Emrich & Dithmar

[57] ABSTRACT

An economical string light includes a molded socket or base having an integral hook for attaching to a messenger wire for support and first and second insulation-displacement connectors for coupling to the electrical power wires. The lamp guard is formed of two identical protector elements which have a coupling collar for connecting to each other and to a retainer flange on the socket. The protector elements are hinged from the coupling collar to open in a clamshell fashion to facilitate lamp replacement, and the protection elements couple together with snap couplers to form the complete lamp guard.

7 Claims, 2 Drawing Sheets

STRING LIGHTS FOR CONSTRUCTION SITES

BACKGROUND AND SUMMARY OF THE INVENTION

The present invention relates to a construction for an electric lampholder of the type used for temporary lighting, such as at a construction site. Such lampholders are typically hung from a support wire, referred to as a "messenger" wire, which is strung across the area to be lighted, as needed. Thus, the lights are known as string lights because they are assembled in a string along the messenger wire. The electrical power feed wires for supplying power to the lamps are then routed to the individual lampholders; and the messenger wire supports the weight of the lamps, the lampholders and the electrical power feed wires.

It has become desirable to provide string lights which are easy to assemble and reliable in use, yet which is very economical. Typically, after construction site string lights are used and the construction project is finished, the string lights are discarded. Therefore, it is desirable to make the string lights as economical as possible. On the other hand, because of the rugged conditions of use, the string lights must be safe and they must be reliable in operation.

BRIEF SUMMARY OF THE INVENTION

The present invention provides an economical string light structure which includes a molded lampholder which provides a socket for receiving the lamp. The socket has an integral hook and a support loop for attaching to a messenger wire for support, depending on the desired use. The lampholder includes first and second insulation-displacement connectors for coupling to the electrical power feed wires quickly and safely, yet very reliably. The insulation-displacement connectors are arranged to apply continuous pressure to the power feed wires to ensure reliable contact is maintained.

A lamp guard attaches to the lampholder to protect the lamp in the lampholder. The lamp guard is formed of two identical protector elements which have a novel coupling collar for connecting to each other and to a retainer flange on the lampholder. The protector elements are preferably identical to each other so that any two can be assembled to provide a complete lamp guard. Each of the protector elements has an L-shaped tab which is hinged to its associated coupling collar and pivots about an axis to connect with a slot in the coupling collar of the mating protector element. The protector elements themselves are hinged from their associated coupling collars so that when they are assembled to a lampholder, the protector elements may be swung upward about horizontal axes in a clamshell fashion to facilitate access to the lamp for replacement. After a lamp is replaced, the protector elements couple together with snap couplers to form the complete lamp guard. Both the lampholder and the lamp guard protector elements can be molded plastic using mass production techniques, thereby reducing the manufacturing costs of the unit.

Thus, the present invention provides an economical, and efficient light for temporary lighting which is easily assembled and facilitates lamp replacement, yet is reliable in use and has few parts. Other features and advantages of the present invention will be apparent to persons skilled in the art from the following detailed description of a preferred embodiment accompanied by the attached drawing wherein identical reference numerals will refer to like parts in the various views.

BRIEF DESCRIPTION OF THE DRAWINGS

FIG. 6 is a top view of the protector element of

DETAILED DESCRIPTION OF A PREFERRED EMBODIMENT

Figure 1:
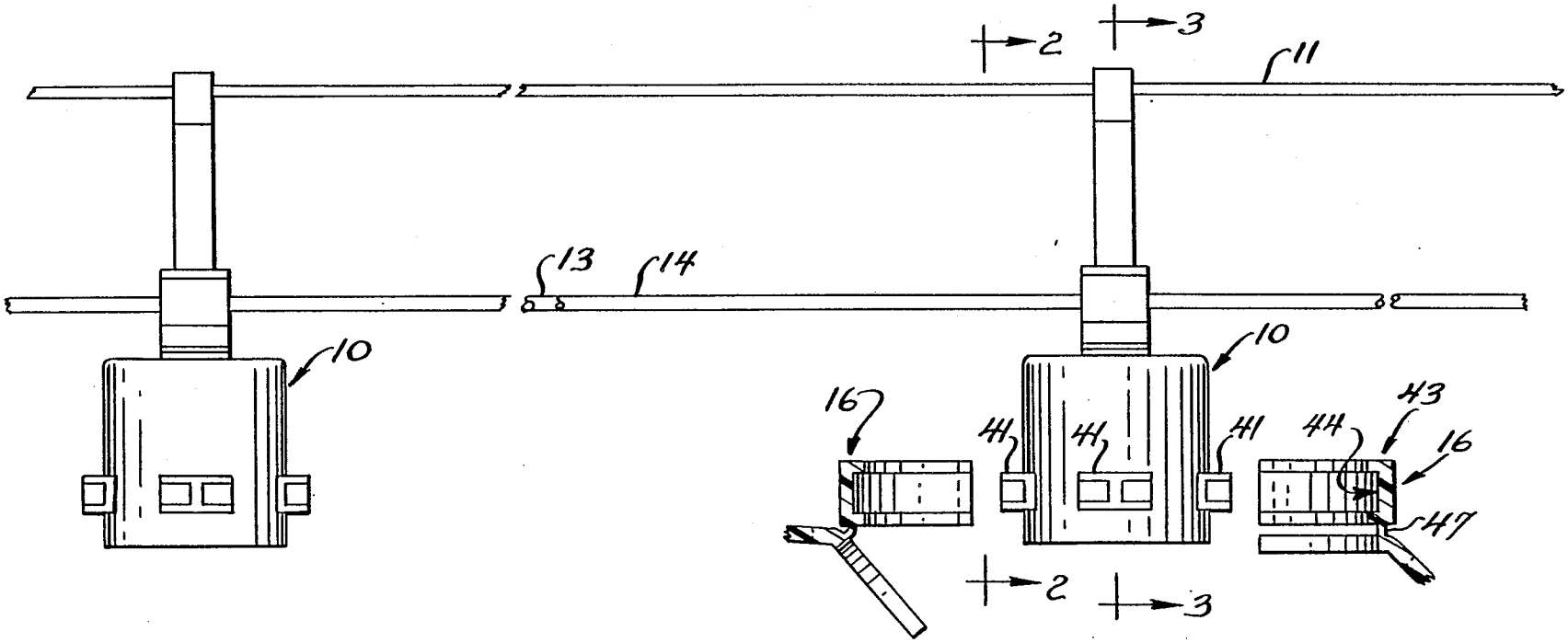
FIG. 1 is a side view showing two lampholders assembled in a typical fashion to a common messenger wire.

Referring first to FIG. 1, reference numeral 10 generally designates a lampholder. There are two lampholders shown in FIG. 1, and they are supported by a common messenger wire 11 which is strung throughout the area desired to be lighted. There are also a pair of conventional electrical power feed wires 13, 14 which are routed to all of the lampholders 10.

Each of the lampholders 10 is identical in structure so that only one need be described for a complete understanding of the invention. Associated with each lampholder 10 is a lamp guard which is formed of two identical side sections, called "protectors", seen in fragmentary form in FIG. 1 and designated 16. Thus, two identical "protectors" 16, once assembled, form the "lamp guard". As illustrated in FIG. 1, the lamp protectors 16 are not assembled to the lampholder 10. As will be made clear, o assemble the protectors to the lampholder 10 and to each other, they are moved toward one another.

Figure 2:
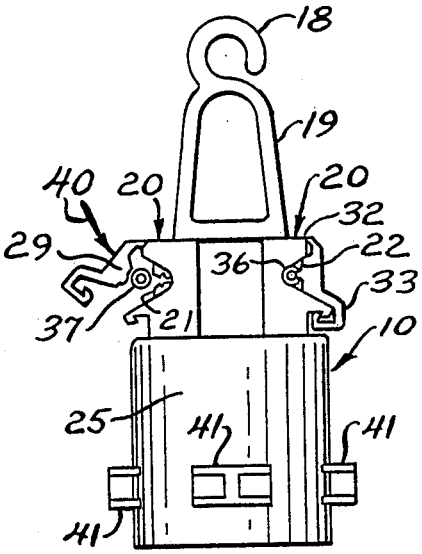
FIG. 2 is a side view of the lampholder of FIG. 1 taken through the sight line 2—2.
Figure 3:
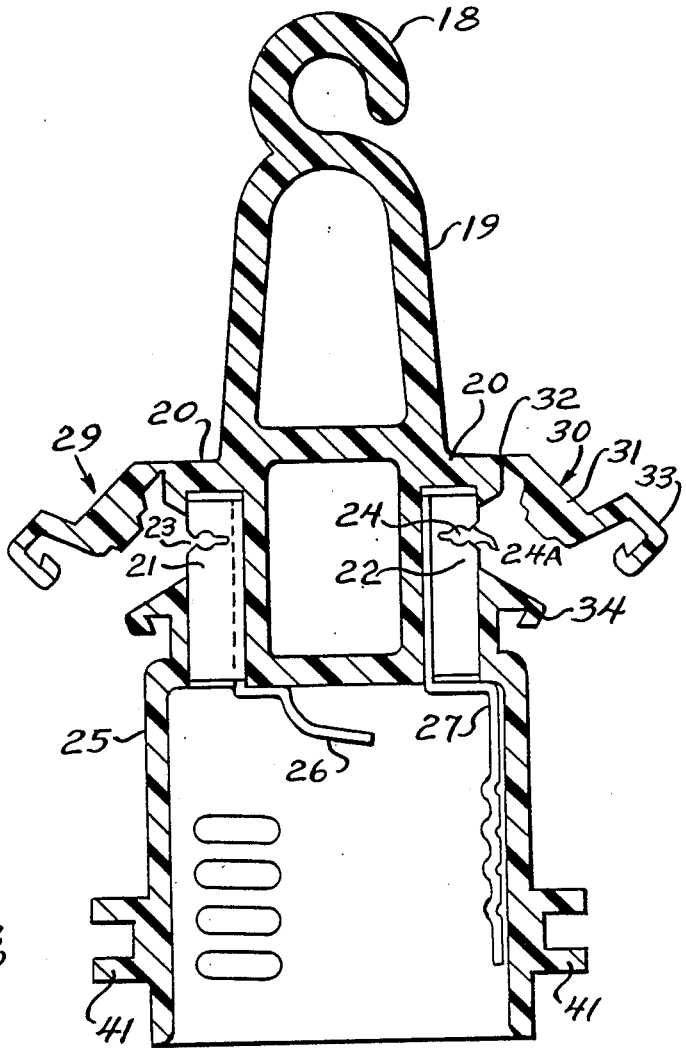
FIG. 3 is a vertical cross-sectional view of the lampholder taken through the sight line 3—3 of FIG. 1.
Figure 5:
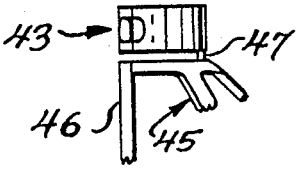
FIG. 5 is a close-up side view in fragmentary form of the upper portion of the protector element of FIG. 4.

Turning now to FIGS. 2 and 3, the lampholder 10 includes an integrally molded body, forming an upper hook 18 which is adapted to be placed on the messenger wire for hanging the lamp when it is desired to support the lamp holders on hooks. For a more secure attachment, the messenger wire may be fed through a bell-shaped, closed support loop 19 beneath the hook 18. At the base of support loop 19, there is formed holders 20 for first and second connector members 21, 22. Each of the connector members 21, 22 includes a wire-receiving slot, designated 23, 24. The slots 23, 24 are each provided with a pair of opposing teeth 24A for cutting the outer insulation on the wire.

Beneath the holders 20 is a socket 25 for receiving a conventional incandescent lamp (not shown). The connector member 21 has an extension 26 which provides an electrical contact for the base of the lamp; and the connector 22 has an extension 27 which extends along the inner wall of the socket 25 and is formed to conform to the threaded portion of the lamp socket to provide the other electrical contact for the lamp.

On opposing sides of the lampholder 10, adjacent the connector members 21, 22, and integrally formed with the lampholder itself, are first and second hinged members 29, 30. The hinge members 29, 30 are similar in structure so that only one need be described in further detail. Turning then to the hinge member 30, it includes an abutting or bearing portion 31 which is thickened and connected to the holder 20 by means of a hinge generally designated 32. At the distal end of the hinge member 30 is a hook generally designated 33. The hook 33 is adapted to fit over and couple to a corresponding latch member 34 formed on the side of the holder portion 20 of the lampholder 10, adjacent the connector element 22.

Referring now particularly to FIG. 2, first and second electrical power feed wires 36, 37 are shown in relation to the connector elements 21, 22. When a wire is inserted at a location adjacent the wire-receiving slot 24 of connector 22, the hinged member 30 is rotated about the hinge 32. Using a pliers or other hand tool, the thickened portion 31 of the hinged member 30 is rotated into the wire 36, forcing the wire into the slot 24 on the connector member 22, thereby causing the connector member 22, by virtue of the size of the slot 24 and the teeth 24A, to cut and separate the insulation of the wire 36 and establish an electrical connection. When the hook 33 is assembled to the latch member 34, the thickened portion 31 of the hinged connector continues to exert pressure to force the wire into electrical contact with the connector 22.

As seen in FIG. 2, the wire 37 is assembled in relation to the connector 21 just prior to pressing the hinged member 29 (in the direction of the arrow 40) to achieve an electrical connection between the wire 37 and the connector 21 of the lampholder. The structure just described thus form insulation-displacement connectors for the power feed wires and avoids the necessity of cutting the power wires or removing insulation from those wires in order to establish a reliable electrical connection.

Spaced about the outer surface of the socket 25 of the lampholder 10 are four connector elements (three of which are seen in FIG. 2 and designated 41). The four connector elements 41 have their centers located approximately 90° from one another as viewed in a horizontal cross-section of the socket 25, and they form a retainer ring or flange for assembling the lamp guard to the lampholder.

Returning to FIG. 1, the lamp protectors 16 each include an upper coupling collar generally designated 43 which has a C-shaped cross-section defining a groove 44 which is dimensioned to received the retainer flange 41 of the lampholder 10. When the coupling collars 43 of two lamp protectors 16 are connected together as described below, the lamp guard is firmly secured to the lampholder.

Figure 4:
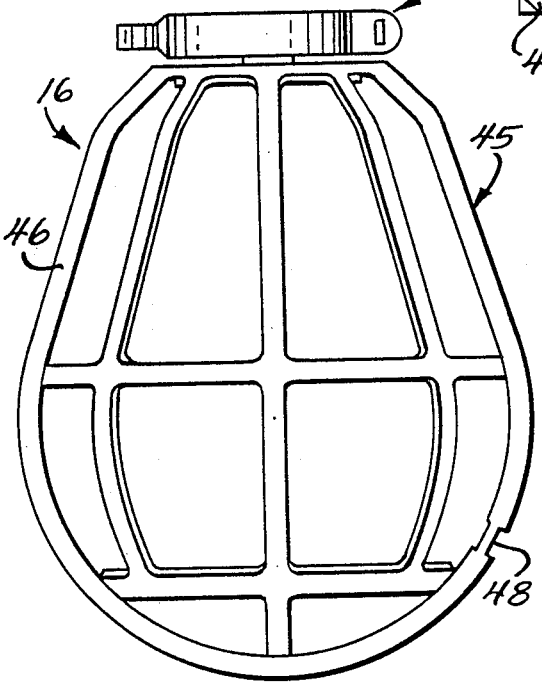
FIG. 4 is a side view of a protector element of a lamp guard for use with the lampholder of FIG. 1.

Turning now to FIG. 4, as mentioned above, each of the lamp protectors 16 which form the lamp guard are identical. A cage-like protector structure generally designated 45 includes a flat peripheral flange 46, and is attached to the upper coupling collar 43 by means of a hinge member 47. On the right side of the peripheral flange 46 of the cage structure 45, as seen in FIG. 4, there is a coupling section 48 of reduced width. At a corresponding location on the left side of the peripheral flange 46, a pair of outwardly-extending projections 49, 50 (see FIG. 6) each provided with inwardly-turned bosses, form a latch for coupling to the associated coupling section 48 of the mating hermaphrodite lamp protector. Thus, the reduced sections 48 of one protector and the projections 49, 50 of an adjacent protector form a releasable snap coupling.

Figure 6:
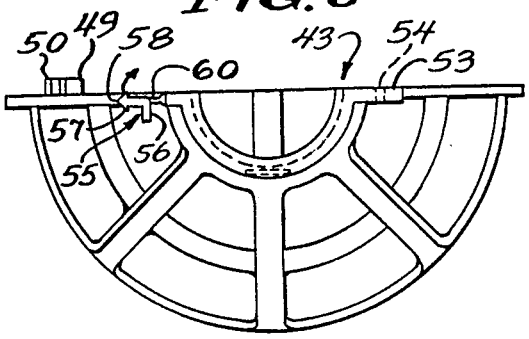

Referring now to FIG. 6, and particularly to the coupling collar 43, the right side of the collar 43 has a radially-outwardly projecting portion 53 which defines a transverse rectangular slot 54. The left side of the collar 43, as seen in FIG. 6, is provided with an L-shaped coupling member generally designated 55 and including a thumb-tab 56 and a barbed connecting element 57. The outer end of the connecting element 57 is in the general shape of an arrowhead as at 58. The coupling member 55 is attached to the collar 43 by a hinge 60.

In assembling the lamp protectors 16 to each other and to the retainer flange of lampholder 10, the connector members 55 are rotated 90° (clockwise as viewed in FIG. 6) by grasping the cage portion 45 in the hand and using the thumb, bearing against the thumb tab 55 to flex the hinge 60, so that the connecting element 57 points upwardly as viewed in FIG. 6. With the connecting members 55 thus rotated, the C-shaped grooves 44 of the coupling collar 43 of the lamp guards are aligned with the retainer flange 41 of the lampholder; and the barbed connecting elements 57 are then inserted into the associated slot 54 of the coupling collar on the mating lamp protector.

With the lamp protectors thus assembled to the lampholder and to each other, the cage guards 45 may be separated by rotation about the hinges 47, as illustrated for the left lampholder in FIG. 1, to facilitate access to insert a lamp in the socket 25 of the lampholder 10. After inserting the lamp, the lamp protectors 45 are hinged toward one another and coupled toward each other by having the projections 49, 50 snap onto the aligned reduced section 48 on the peripheral flange 46 of the adjacent cage guard. The protectors may easily be separated simply by holding the cage portions and unlatching the snap couplers 48, 49, 50 as described.

It will thus be appreciated that identical lamp protectors 16 are used to form a lamp guard and are conveniently and easily assembled and which are reliably coupled to the lampholder, yet permit hinging in a clamshell fashion to provide access to the lamp protected by the cage guards. All of this is accomplished in a simple and economical structure, one which is sufficiently reliably that it can be used for an extended period under the somewhat rugged conditions found on construction sites, yet it is sufficiently inexpensive that it can be discarded after use.

Having thus disclosed in detail a preferred embodiment of the invention, persons skilled in the art will be able to modify certain of the structure which has been disclosed and to substitute equivalent elements for those illustrated while continuing to practice the principle of the invention; and it is, therefore, intended that all such modifications and substitutions be covered as they are embraced within the spirit and scope of the appended claims.

I claim:

1. A plurality of string lights adapted to be hung on a common messenger wire at spaced intervals to provide light for an area, each of said string lights comprising: a lampholder defining mean for attaching to said messenger wire and a socket for receiving a lamp, said lamp holder further including first and second electrical connector means for attaching to electrical power feed lines to energize a lamp received in said socket; means defining a peripheral retainer flange on the exterior of said socket; and a lamp guard comprising first and second similar lamp protectors, each lamp protector including an upper collar defining a groove for coupling to a portion of said retainer flange on said socket and a hinging coupling member at one end of said collar and including a connecting element, the other end of said collar extending laterally outwardly and defining a slot for receiving an associated connecting element of an adjacent lamp protector, said lamp protector further including a cage guard and a hinge extending from said collar to said cage guard to permit said cage guard to swing outwardly and upwardly relatively to said collar, and releasable snap coupling means for coupling to an associated cage guard at a location remote from said collar.

2. The apparatus of claim 1 wherein said electrical connectors of said lampholder are insulation-displacement connectors, each including an upright blade received in said holder and defining a wire-receiving slot, each connector blade including an extension for coupling to a lamp received in said socket; and a member hinged to the body of said lamp holder and molded integrally therewith and including a bearing portion for engaging the wire and forcing the wire into said wire receiving slot of an associated connector blade.

3. The apparatus of claim 2 wherein said hinged members of said insulation-displacement connectors further comprise a hook member for latching to an associated latch member integrally molded to the body of said socket when said bearing portion of a hinged member is forced against a powerfeed wire to connect said wire to an associated connector blade for latching said hinged member thereto and to continue to apply force to said wire to keep said wire in its associated wire-receiving slot.

4. The apparatus of claim 1 wherein said retainer flange of said socket comprises four bosses having their centers located approximately 90° from one another around the periphery of said socket.

5. The apparatus of claim 1 wherein said cage guards each include a flat peripheral flange, and wherein said snap coupling means comprises a portion of reduced thickness on one side of said flange and a pair of opposed projections at a corresponding location on the other side of said flange for latching to the reduced thickness portion of the flange of an associated cage guard to releasably couple said cage guards together in a snap coupling.

6. The apparatus of claim 5 wherein said hinging coupling member of said lamp guard comprises an L-shaped member defining a thumb tab and a projecting connector element at right angles relative to one another and a molded hinge connecting said L-shaped member adjacent the bend thereof to one side of an associated coupling collar and in a location such that when the L-shaped member is rotated about its hinge, the projecting connector element is aligned with the coupling slot of an adjacent lampholder and may be inserted in said slot by pressing said thumb tab.

7. The apparatus of claim 1 wherein said means for attaching to a messenger wire comprises a support loop formed integrally with said socket and a hook above said support loop whereby said lampholder may be releasably secured to said messenger wire or more permanently secured by threading said messenger wire through said support loop.

* * * * *

UNITED STATES PATENT AND TRADEMARK OFFICE

CERTIFICATE OF CORRECTION

PATENT NO. : 4,841,420

DATED : June 20, 1989

INVENTOR(S) : Horacio A. Baggio and George R. Eckart

It is certified that error appears in the above—identified patent and that said Letters Patent is hereby corrected as shown below:

In Col. 2, line 17, after "element of" add --FIG. 4--, and line 37, "o" should be --to--.

Signed and Sealed this

Fifth Day of June, 1990

*Attest:*

HARRY F. MANBECK, JR.

*Attesting Officer*

*Commissioner of Patents and Trademarks*